US006568544B1

(12) United States Patent
Lafond et al.

(10) Patent No.: US 6,568,544 B1
(45) Date of Patent: May 27, 2003

(54) TEST TUBE SUPPORT ASSEMBLY

(75) Inventors: André Lafond, St-Hilaire (CA); Yanick Bertin, Verchères (CA)

(73) Assignee: 3088081 Canada Inc. (CA)

( * ) Notice: Subject to any disclaimer, the term of this patent is extended or adjusted under 35 U.S.C. 154(b) by 0 days.

(21) Appl. No.: 10/152,748

(22) Filed: May 22, 2002

(51) Int. Cl.[7] ..... A47B 73/00
(52) U.S. Cl. ..... 211/74
(58) Field of Search ..... 211/74, 85.13; 422/101, 104

(56) References Cited

U.S. PATENT DOCUMENTS 4,284,603 A * 8/1981 Korom ..... 422/101
4,495,150 A * 1/1985 Cook et al. ..... 211/74 X
5,128,105 A * 7/1992 Berthold et al. ..... 422/104
5,169,603 A * 12/1992 Landsberger ..... 422/104
6,098,819 A * 8/2000 Link ..... 211/85.13
6,132,684 A * 10/2000 Marino ..... 211/74 X

* cited by examiner

*Primary Examiner*—Robert W. Gibson, Jr.
(74) *Attorney, Agent, or Firm*—Akerman Senterfitt

(57) ABSTRACT

A support assembly for receiving and holding a series of test tubes is formed of a base plate receiving the bottom ends of the tubes, an intermediate frame displaying an array of openings to receive the tubes and a top frame also displaying an array of tube receiving openings in vertical registry with the array of openings of the intermediate frame. The base plate and the top frame have outwardly extending opposite ends that are adapted to snappingly engage one another together with the opposite ends of the intermediate frame. The intermediate frame and the top frame include one or more removable frame sections each having openings of a given configuration to correspond to the configuration of tubes so that the support is adaptable to receive tubes of varying configuration. Similarly, the base plate has one or more removable sections to correspond to the configuration of the bottom ends of the tubes.

21 Claims, 6 Drawing Sheets

TEST TUBE SUPPORT ASSEMBLY

FIELD OF THE INVENTION

The present invention pertains to a support assembly for receiving and holding a series of test tubes, the support being alterable to suit various configurations of test tubes.

BACKGROUND OF THE INVENTION

At present, test tube supports consist of a fixed assembly consisting of vertically spaced frames having a series of openings for receiving test tubes therein. However, there are as many different types of supports as there are different sizes of test tubes. This evidently creates a storage problem due to the various types of supports. Also, because the supports consist of a fixed assembly, the transporting space is of importance.

OBJECTS AND STATEMENT OF THE INVENTION

It is an object of the present invention to provide a support assembly for receiving and holding a series of test tubes which is so constructed as to enable it to be alterable to suit various configurations of test tubes. This is achieved by providing a support formed of a base plate, an intermediate frame and a top frame, each having removable sections so that other sections may be used to fit the configuration of various types of test tubes.

It is also an object of the present invention to provide a test tube support assembly which the base plate, the intermediate frame and the top frame are easily dismountable from one another so that the transport of these supports require less space.

The present invention therefore relates to a support assembly for receiving and holding a series of test tubes which comprises:

- a base plate to receive bottom ends of the tubes; the base plate having upwardly extending opposite ends;
- an intermediate frame displaying an array of openings to receive the tubes therein; the intermediate frame having opposite ends supported on the upwardly extending ends of the base plate; and
- a top frame displaying an array of tube receiving openings in vertical registry with the array of openings of the intermediate frame; the top frame having downwardly extending opposite ends snappingly engaging the opposite ends of the intermediate frame and the upwardly extending ends of the base plate;
- whereby the intermediate frame and the top frame include one or more removable frame sections each having openings of a given configuration corresponding to the configuration of tubes received therein so that the support is adaptable to receive tubes of varying configuration.

The present invention also pertains to a test tube support assembly which also comprises:

- a base plate displaying an array of wells to receive the bottom ends of the tubes; the base plate having upwardly extending opposite ends; and
- a top frame displaying an array of tubes receiving openings in vertical registry with the array of the wells of the base plate; the top frame having opposite ends supported on the upwardly extending ends of the base plate;

- wherein the top frame includes one or more removable sections each having openings of a given configuration corresponding to the configuration of tubes received therein so that the support is adaptable to receive tubes of varying configuration.

In one preferred form of the invention, the base plate and the top frame each define a rectangular frame, in which the removable sections are mounted, which are identically shaped thereby reducing the number of differently shaped components of the support.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
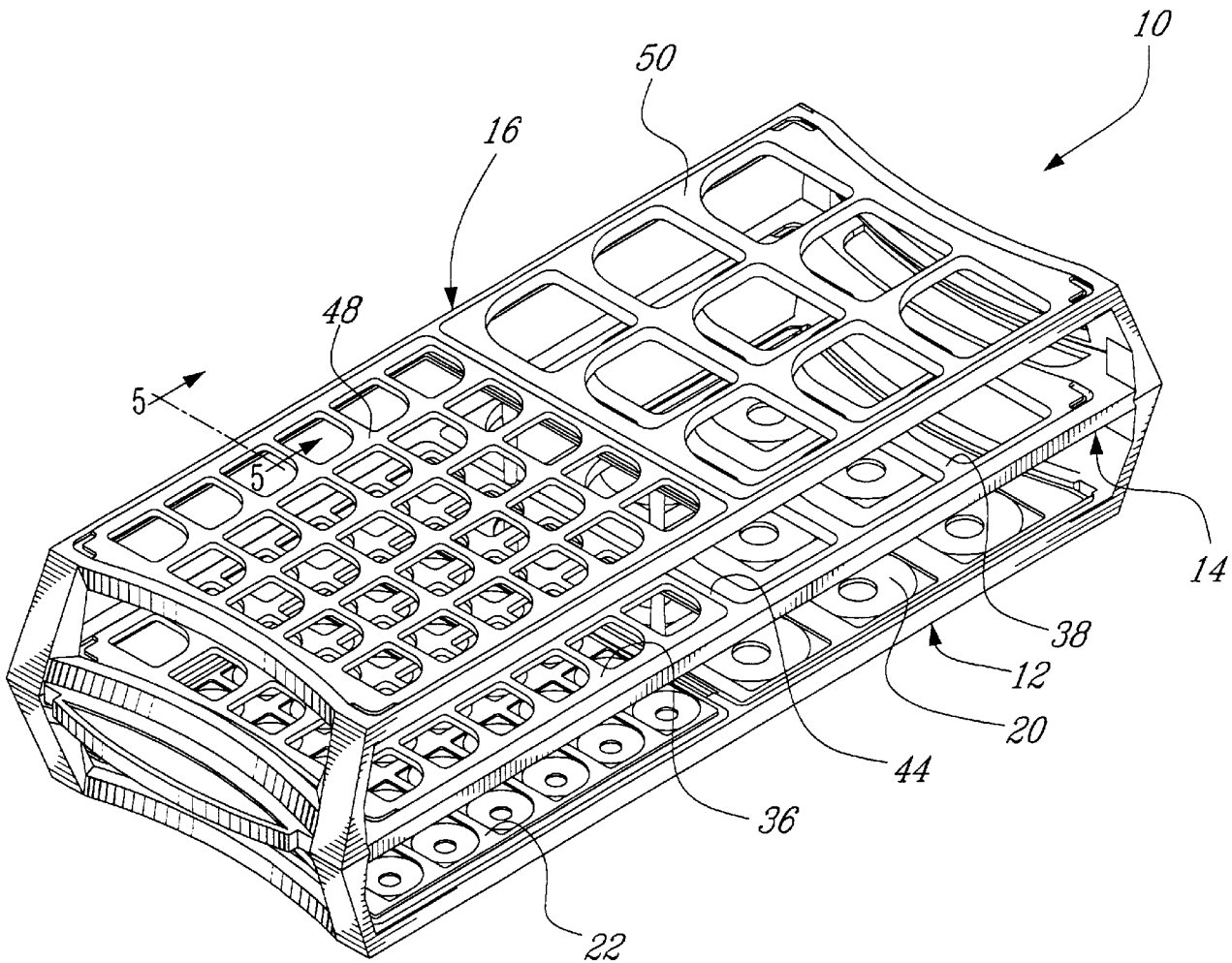
FIG. 1 is a perspective view of a test tube support made in accordance with the present invention.
Figure 2:
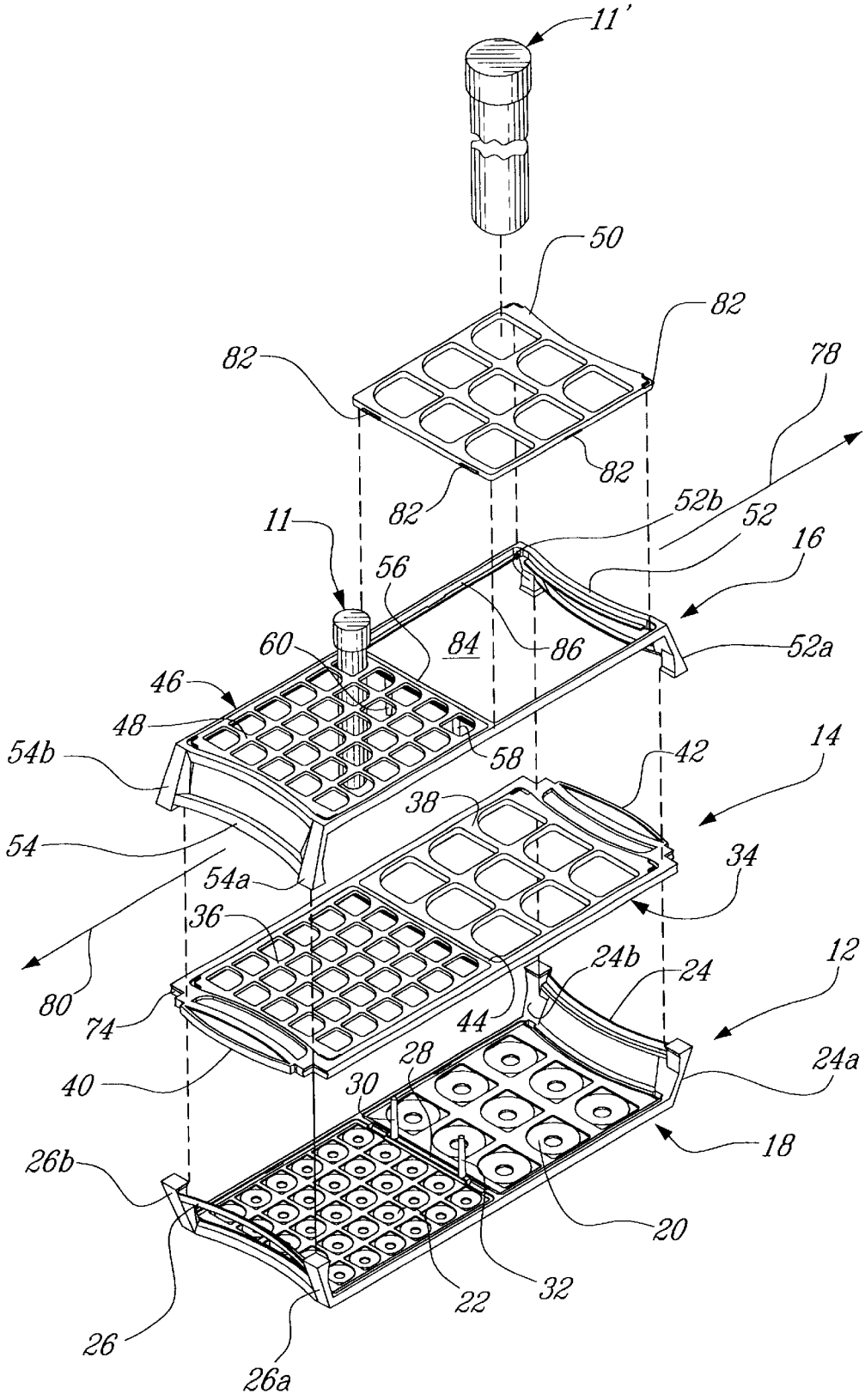
FIG. 2 is an exploded view of the test tube support of FIG. 1.
Figure 3:
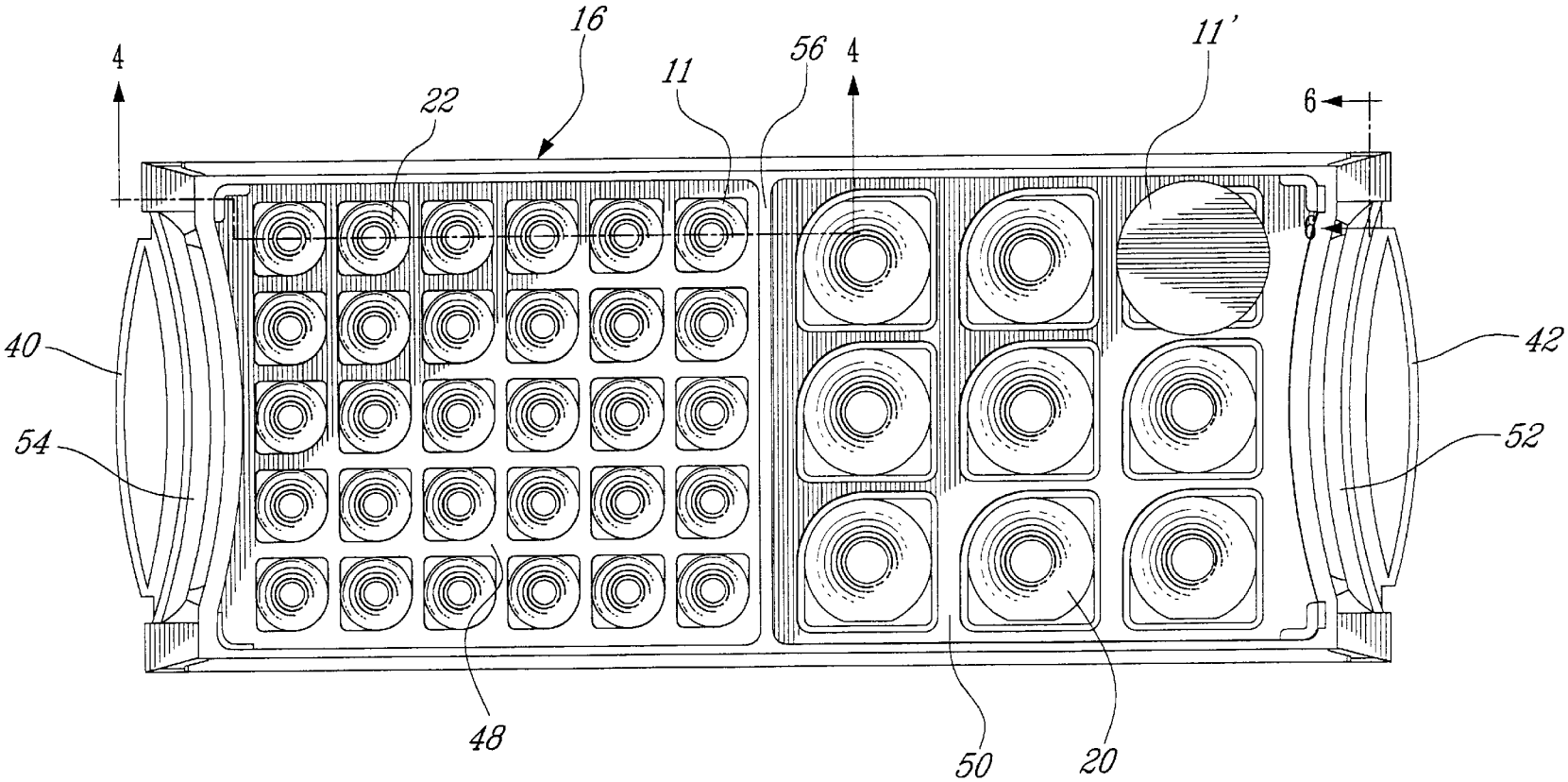
FIG. 3 is a top view of the test tube support of FIG. 1.

Referring to FIGS. 1 and 2, there is shown a test tube support, generally denoted 10, for receiving and holding a series of test tubes 11, 11' of two different sizes. The support 10 comprises a base plate 12, an intermediate frame 14 and a top frame 16.

The base plate 12 consists of a rectangular frame 18 in which is received, in the embodiment illustrated, a pair of removable sections 20 and 22 configured to receive the bottom ends of the test tubes. The frame 18 displays a pair of upwardly and outwardly extending opposite ends 24 and 26 and a central transverse frame member 28. Frame 18 also displays a pair of openings in which are lodged the removable sections 20 and 22. A pair of the integrally formed supports 30 and 32 extends upwardly from the central frame member 28. The removable sections 20 and 22 of the base plate 12 define an array of wells to fit the bottom ends of the tubes 11, 11'. In the embodiment illustrated, these wells each include a central hole allowing liquid to pass therethrough.

The intermediate frame 14 consists of a rectangular frame 34 which displays a pair of openings in which are lodged a pair of removable sections 36 and 38. The peripheral frame 34 displays a pair of opposite ends 40 and 42 defining handles for carrying the test tube support 10. The peripheral frame 34 includes a central frame member 44 in vertical alignment with the central frame member 28 of the base plate and its vertical supports 30 and 32.

The top frame 16 consists of a rectangular frame 46 which displays a pair of openings in which are lodged a pair of removable sections 48 and 50. The rectangular frame 46 has outwardly and downwardly extending opposite ends 52 and 54 and a central frame member 56 in vertical alignment with the frame member 44 of the intermediate frame 14 and the frame member 28 of the base plate 12. The central frame member 56 displays a pair of integrally formed downwardly extending vertical supports 58 and 60.

In a preferred form of the invention, the rectangular frame of the base plate 12 and the rectangular frame of the top frame 16 are identically constructed thus reducing the number of different components forming part of the support assembly.

The removable sections 36, 38, 48 and 50 each define an array of tube openings so as to suit the various shapes and sizes of test tubes (such as tubes 11 and 11') to be supported.

The assembly of the base plate, the intermediate frame and the top frame together will now be described. It should be mentioned that the material of the support 10 is preferably made of a resilient plastic material which is capable of being slightly deformed but which can spring back to its initial condition thereafter. This is important since in order to carry out the assembly, certain components must be deformed slightly as explained hereinbelow.

Figure 4:
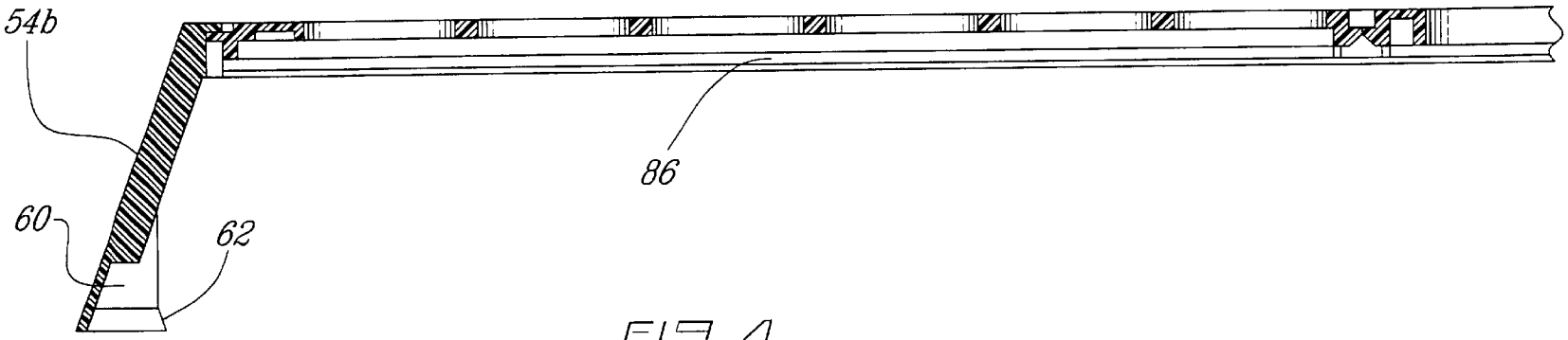
FIG. 4 is a cross-sectional view taken along lines 4—4 of FIG. 3.

The outwardly and upwardly extending end 24 of the rectangular frame 18 of the base plate 12 includes a pair of leg sections 24*a* and 24*b* while the outwardly and downwardly extending end 52 of the top frame 16 includes a pair of leg portions 52*a* and 52*b*. Similarly, the opposite end 26 of plate 12 has a pair of leg sections 26*a* and 26*b* while the end 54 of top frame 16 has a pair of leg sections 54*a* and 54*b*. As exemplified in FIG. 4, each of these leg sections has an enlarged extremity 60 with a chamfered inner edge 62.

Figure 6:
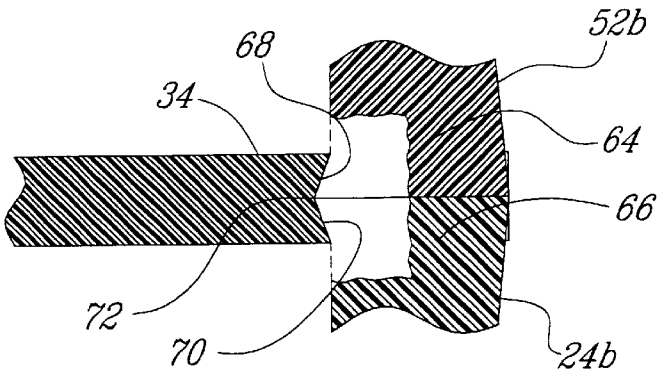
FIG. 6 is a cross-sectional view taken along lines 6—6 of FIG. 3.

Referring to FIG. 6, the assembly of legs 24*b* and 52*b* with the intermediate frame 34 is illustrated to show the interconnection of the base plate, the intermediate frame and the top frame to one another. Leg section 52*b* has an enlarged extremity 64 resting on the enlarged extremity 66 of leg section 24*b*. Their respective chamfered inner edges 68 and 70 fit into a V-shaped recess 72 formed at the extremity of the intermediate frame 34 (such V-shaped extremity can also be seen as 74 on an opposite end of frame 34 in FIG. 2). To achieve the assembly illustrated in FIG. 6, the intermediate frame 34 is placed to rest on the upper extremities of legs 24*a*, 24*b*, 26*a* and 26*b* of the base plate 12. Then, the top frame 16 is placed thereover so that its legs 52*a*, 52*b* lie over legs 24*a* and 24*b* of the base plate 12 and, similarly, legs 54*a* and 54*b* over the legs 26*a* and 26*b*. However, the assembly can only be performed if one (or both) of the end sections 52 and 52*b* is slitghtly stretched outwardly as indicated by arrow 78 (or arrow 80) so that the legs may thereafter spring back into the V-shaped extremity 72 (or 74) of the intermediate frame 14.

Figure 5:
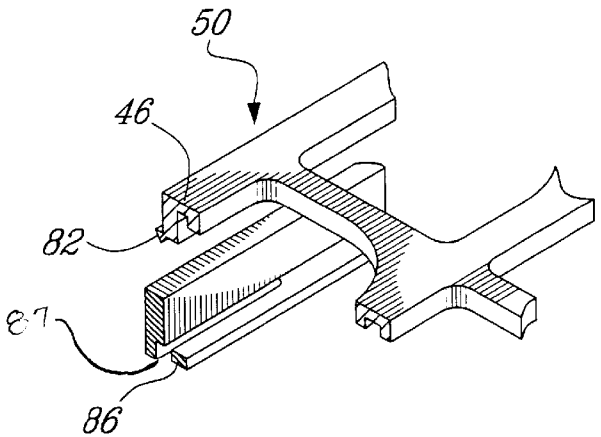
FIG. 5 is a cross-sectional view taken along lines 5—5 of FIG. 1.

The engagement and disengagement of a removable section from any of the components 12, 14 and 16 will now be described with reference to FIGS. 2 and 5 and more particularly, with respect to the removable section 54 from the rectangular frame 46 of the top frame 16.

First, it should be noted that each removable section, such as 50, comprises along its periphery a series of prongs 82 that slidely extends outwardly from the walls of the frame. Secondly, each rectangular opening (for example 84 of the rectangular frame 46) displays a peripheral inner shoulder 86 which displays, along its periphery, a series of openings 87 located to receive corresponding prongs 82 of the removable section. The construction of these prongs is such that the removable section may be snapped in or out of the opening 84, again as a result of the resilient plastic material used.

Figure 7:
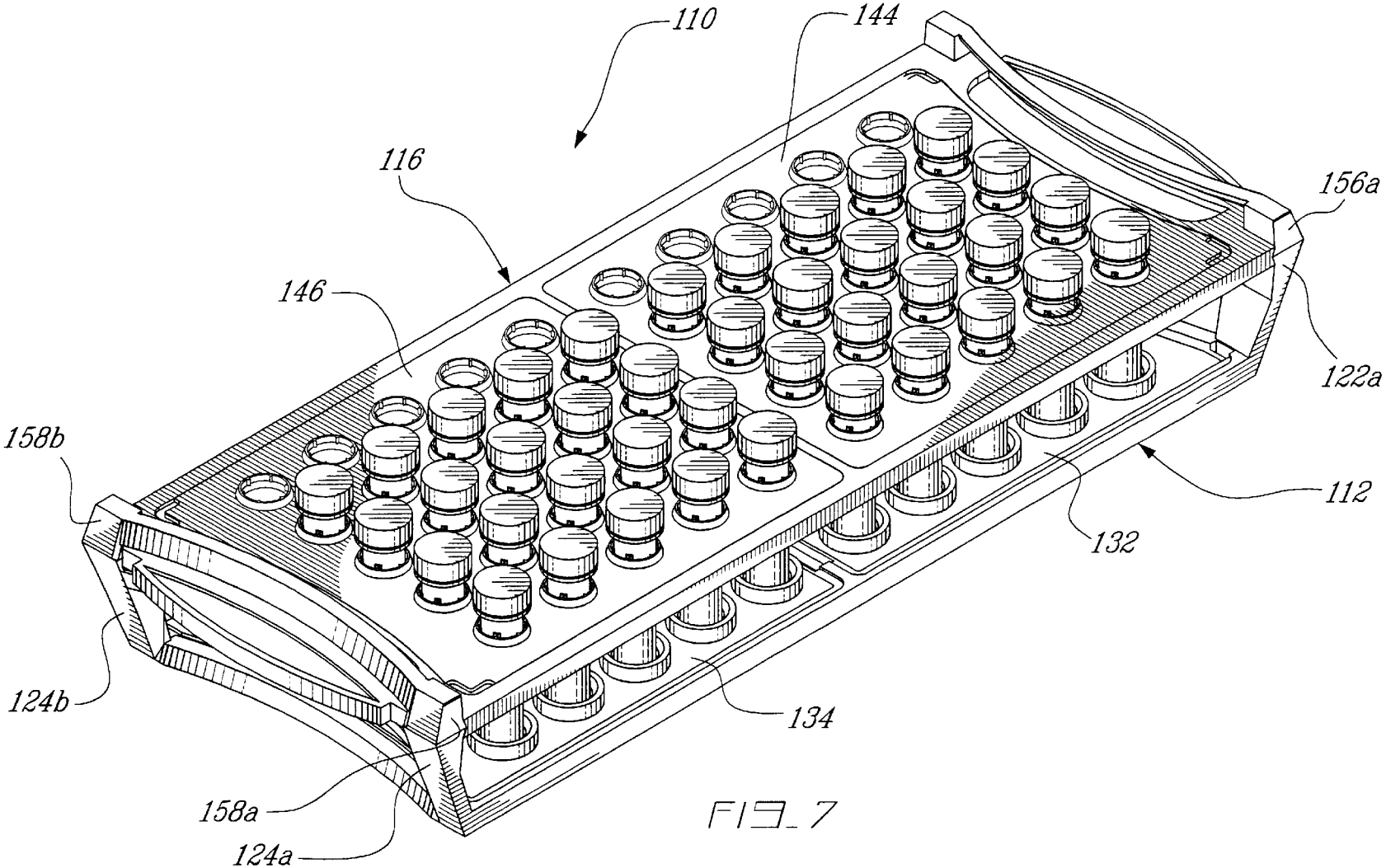
FIG. 7 is a perspective view of another embodiment of a test tube support made in accordance with the present invention.
Figure 8:
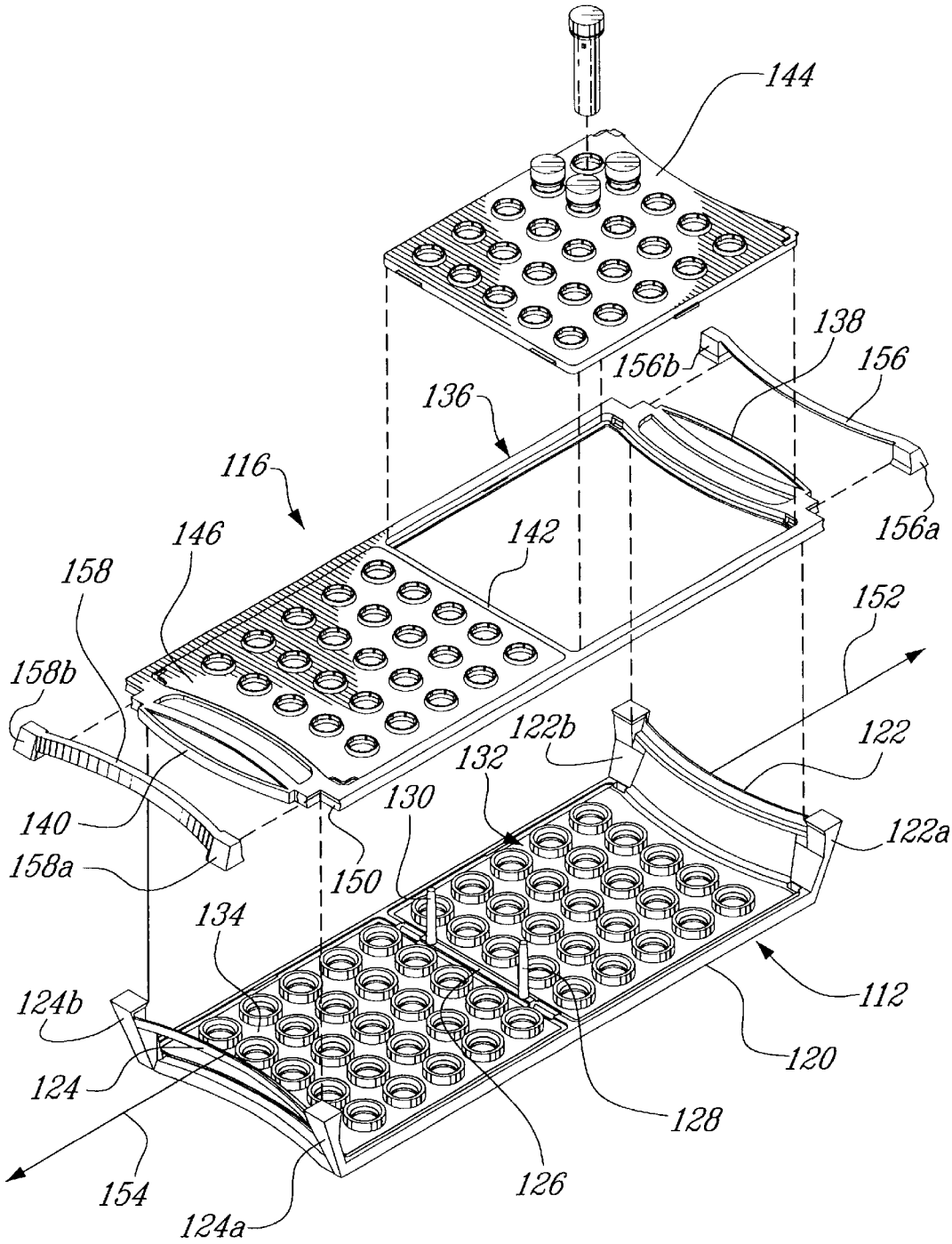
FIG. 8 is an exploded view of the test tube support shown in FIG. 7.

Referring to FIGS. 7 and 8, there is shown another embodiment of a support assembly made in accordance with the present invention. The test tube support assembly, generally denoted 110, comprises a base plate 112 and a top frame 116.

The base support 112 displays a rectangular frame 120 having opposite ends sections 122 and 124 each having respective leg sections 122*a* and 122*b*, 124*a* and 124*b*. The rectangular frame 120 also includes a central transverse member 126 from which upwardly extends a pair of legs supports 128 and 130. The base support 112 receives a pair of removable well displaying sections 132 and 134.

The construction of the base support 112 is identical to the base support 12 illustrated in FIGS. 1–6; a further detailed description is therefore not considered necessary.

Similarly, the top frame 116 has a construction identical to the intermediate frame 14 of the embodiment illustrated in FIGS. 1–6.

Frame 116 essentially comprises a rectangular frame 136 having a pair of opposite ends 138 and 140 providing handles to the support assembly. A central frame member 42 divides the frame into two openings to receive a pair of removable sections 144 and 146. These removable sections display an array of tube receiving openings which are in vertical registry with wells of the removable sections of the base plate.

Therefore, the assembly of the support illustrated in FIGS. 7 and 8 is substantially identical to part of that described above with respect to the embodiment illustrated in FIGS. 1–6 and, more particularly to the engagement of the base plate and the intermediate plate, namely by slightly stretching outwardly, as indicated by arrows 152 and 154, the opposite ends 122 and 124 of the base plate so that the chamfered corners of the leg sections engage in the V-shaped corners of the top frame 116. However, due to the absence of a third frame (such as illustrated in the embodiment of FIGS. 1–6), the assembly is completed by a pair of connecting parts 156 and 158 which respectively have opposite ends 156*a*, 156*b* and 158*a* and 158*b* similarly shaped as the lower extremities of the leg sections 52*a*, 52*b*, 54*a*, 54*b* of the top frame 46 of the embodiment illustrated in FIGS. 1–6. These ends have chamfered edges which also engage the V-shaped corners 150 in a manner similar to that illustrated in FIG. 6 thereby completing the assembly.

Although the invention has been described above with respect to two specific forms, it will be evident to the person skilled in the art that it may be modified and refined in various ways. For example, the rectangular frame of each plate is shown to include a pair of removable sections. However, it is possible to have test support assembly where there would be a single removable section per component or, in some cases, more than two removable sections. It is therefore wished to have it understood that the present invention should not be limited in interpretation, except by the terms of the following claims.

What is claimed is:

1. A test tube support assembly for receiving and holding a series of test tubes, said support capable of being altered to suit various configurations of test tubes, comprising:

a base plate to receive bottom ends of said tubes; said base plate having upwardly extending opposite ends;

an intermediate frame displaying an array of openings to receive said tubes therein; said intermediate frame having opposite ends supported on said upwardly extending ends of said base plate; and a top frame displaying an array of tube receiving openings in vertical registry with said array of openings of said intermediate frame; said top frame having downwardly extending opposite ends snappingly engaging said opposite ends of said intermediate frame and said upwardly extending ends of said base plate;

whereby said intermediate frame and said top frame include one or more removable frame sections each having openings of a given configuration corresponding to the configuration of tubes received therein so that said support is adaptable to receive tubes of varying configuration.

2. A test tube support assembly as defined in claim 1, wherein said base plate displays an array of wells shaped to receive said bottom ends of said tubes; said array of wells being in vertical registry with said openings of said intermediate frame.

3. A test tube support assembly as defined in claim 2, wherein said base plate includes one or more removable well displaying sections.

4. A test tube support assembly as defined in claim 3, wherein said base plate consists of a rectangular peripheral frame and of said well displaying sections.

5. A test tube support assembly as defined in claim 4, wherein said top frame consists of a rectangular peripheral frame member and of said removable frame sections thereon.

6. A test tube support assembly as defined in claim 5, wherein said intermediate frame consists of a rectangular peripheral frame member and of said removable frame sections thereon.

7. A test tube support assembly as defined in claim 6, wherein said peripheral frame of said base plate and said peripheral frame member of said top frame are identically shaped and assembled in inverse manner relative to one another.

8. A test tube support assembly as defined in claim 7, wherein said peripheral frame of said base plate and said peripheral frame member of said top frame each display a central transverse frame member; a pair of vertical legs being integrally formed to said transverse frame member.

9. A test tube support assembly as defined in claim 8, wherein said peripheral frame member of said intermediate frame display a central transverse frame member; said pair of vertical legs of said top frame and said base plate contacting said transverse frame member of said intermediate frame.

10. A test tube support assembly as defined in claim 3, wherein said removable well displaying sections are snappingly engaged to said peripheral frame.

11. A test tube support assembly as defined in claim 5, wherein said removable frame sections of said base plate and of said top frame are snappingly engaged to said rectangular peripheral frames thereof, respectively.

12. A test tube support assembly as defined in claim 1, wherein each said opposite end of said intermediate frame displays an integral handle extension.

13. A test tube support assembly as defined in claim 1, wherein said base plate, said intermediate frame and said top frame are made of resilient plastic material to enable a snap-in engagement of said opposite ends of said base plate, intermediate frame and top frame to one another.

14. A test tube support assembly for receiving and holding a series of test tubes having varying configurations, comprising:

a base plate displaying an array of wells to receive bottom ends of said tubes; said base plate having upwardly extending opposite ends; and a top frame displaying an array of tubes receiving openings in vertical registry with said array of said wells of said base plate; said top frame having opposite ends supported on said upwardly extending ends of said base plate;

wherein said top frame includes one or more removable sections each having openings of a given configuration corresponding to the configuration of tubes received therein so that said support is adaptable to receive tubes of varying configuration.

15. A test tube support assembly as defined in claim 14, wherein said base plate includes one or more removable well displaying sections each having wells of a given configuration corresponding to the configuration of the bottom ends of the tubes.

16. A test tube support assembly as defined in claim 15, wherein said base plate consists of a rectangular peripheral frame and of said well displaying sections.

17. A test tube support assembly as defined in claim 14, wherein said top frame consists of a rectangular peripheral frame member and of said removable frame sections thereon.

18. A test tube support assembly as defined in claim 17, wherein said peripheral frame of said base plate and said peripheral frame member of said top frame each display a central transverse frame member; a pair of vertical legs being integrally formed to said transverse frame member.

19. A test tube support assembly as defined in claim 15, wherein said removable well displaying sections are snappingly engaged to said peripheral frame.

20. A test tube support assembly as defined in claim 14, wherein said removable frame sections of said base plate and of said top frame are snappingly engaged to said rectangular peripheral frames thereof, respectively.

21. A test tube support assembly as defined in claim 14, wherein each said opposite end of said intermediate frame displays an integral handle extension.

* * * * *